US010595585B2

(12) United States Patent
Bacon et al.

(10) Patent No.: US 10,595,585 B2
(45) Date of Patent: Mar. 24, 2020

(54) GOLF SHOE WITH AN OUTSOLE HAVING WAVE-LIKE FLEX CHANNELS

(71) Applicant: Acushnet Company, Fairhaven, MA (US)

(72) Inventors: Jonathan G. Bacon, East Taunton, MA (US); Robert S. Bento, Raynham, MA (US); Douglas K. Robinson, Jr., Mansfield, MA (US); James M. Feeney, Marion, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 16/007,607

(22) Filed: Jun. 13, 2018

(65) Prior Publication Data

US 2018/0289103 A1 Oct. 11, 2018

Related U.S. Application Data

(63) Continuation of application No. 15/200,488, filed on Jul. 1, 2016, now Pat. No. 9,999,275.

(51) Int. Cl.

| | |
|---|---|
| ***A43B 5/00*** | (2006.01) |
| ***A43B 13/14*** | (2006.01) |
| ***A43B 13/26*** | (2006.01) |
| ***A43C 15/16*** | (2006.01) |
| ***A43C 13/04*** | (2006.01) |
| ***A43B 1/00*** | (2006.01) |
| ***A43B 3/00*** | (2006.01) |
| ***A43B 13/12*** | (2006.01) |

(52) U.S. Cl.

CPC ..... *A43B 5/001* (2013.01); *A43B 1/0072* (2013.01); *A43B 3/0078* (2013.01); *A43B 5/00* (2013.01); *A43B 13/12* (2013.01); *A43B 13/141* (2013.01); *A43B 13/26* (2013.01); *A43C 13/04* (2013.01); *A43C 15/16* (2013.01); *A43C 15/161* (2013.01)

(58) Field of Classification Search

CPC .. A43B 5/00; A43B 5/001; A43B 5/02; A43B 13/141; A43C 13/04; A43C 15/16

USPC ..... 36/102, 127, 134, 59 R, 59 C, 67 D, 36/67 R; D2/951, 953, 960

See application file for complete search history.

(56) References Cited

U.S. PATENT DOCUMENTS 4,507,879 A * 4/1985 Dassler ..... A43B 5/02 36/102
4,559,723 A * 12/1985 Hamy ..... A43B 5/00 36/102
4,559,724 A * 12/1985 Norton ..... A43B 5/06 36/114
5,313,717 A * 5/1994 Allen ..... A43B 13/20 36/153
5,384,973 A * 1/1995 Lyden ..... A43B 13/12 36/102

(Continued)

*Primary Examiner* — Marie D Bays

(74) *Attorney, Agent, or Firm* — Burns & Levinson, LLP; Joseph M. Maraia; Daniel J. McGrath

(57) ABSTRACT

A golf shoe has an upper, a midsole, and an outsole. The outsole includes a plurality of wave-like flex channels, surrounded by a hard base material. The hard base material provides stiffness for support and stability while the flex channels allow the outsole to bend when a user walks or swings a golf club. The outsole also has a plurality of receptacles for attaching and removing cleats, providing traction between the golf shoe and a ground surface.

15 Claims, 9 Drawing Sheets

(56) References Cited

U.S. PATENT DOCUMENTS 5,979,083 A * 11/1999 Robinson ..... A43B 1/0072 36/102
D420,501 S * 2/2000 Hlavacs ..... D2/972
6,161,315 A * 12/2000 Dalton ..... A43B 5/001 36/134
6,289,611 B1 * 9/2001 Patterson ..... A43B 5/001 36/127
6,802,139 B2 * 10/2004 Pitts ..... A43B 23/047 36/127
D524,016 S * 7/2006 Robinson, Jr. ..... D2/902
D528,286 S * 9/2006 Schambra ..... D2/972
D532,964 S * 12/2006 Kuerbis ..... D2/972
7,143,529 B2 * 12/2006 Robinson, Jr. ..... A43B 1/0072 36/127
D560,885 S * 2/2008 Lane, III ..... D2/953
D571,997 S * 7/2008 Teeter ..... D2/969
D587,442 S * 3/2009 Robinson, Jr. ..... D2/953
D593,736 S * 6/2009 Mochen ..... D2/951
7,650,707 B2 * 1/2010 Campbell ..... A43B 3/0057 36/102
D628,786 S * 12/2010 Lane, III ..... D2/969
D654,681 S * 2/2012 Bacon ..... D2/906
D666,404 S * 9/2012 Shaffer ..... D2/972
8,677,657 B2 * 3/2014 Bacon ..... A43B 5/001 36/103
D707,027 S * 6/2014 Shaffer ..... D2/972
D707,028 S * 6/2014 Parker ..... D2/972
D707,432 S * 6/2014 Mochen ..... D2/951
D707,929 S * 7/2014 Feeney ..... D2/951
D724,828 S * 3/2015 Lonigan ..... D2/951
D746,562 S * 1/2016 Babcock ..... D2/951
D776,412 S * 1/2017 Carboy ..... D2/951
D789,056 S * 6/2017 Tzenos ..... D2/951
9,999,275 B2 * 6/2018 Bacon ..... A43B 5/001
2006/0242863 A1 * 11/2006 Patmore ..... A43B 13/26 36/127
2009/0056169 A1 * 3/2009 Robinson, Jr. ..... A43B 5/001 36/102
2009/0113765 A1 * 5/2009 Robinson, Jr. ..... A43B 3/0078 36/127
2009/0188132 A1 * 7/2009 Fujikawa ..... A43B 3/0068 36/103
2014/0026438 A1 * 1/2014 Cortez ..... A43B 13/181 36/28
2014/0215853 A1 * 8/2014 Rushbrook ..... A43B 5/001 36/102
2015/0096195 A1 * 4/2015 Bacon ..... A43B 1/0072 36/87
2015/0366289 A1 * 12/2015 Rustam ..... A43B 13/188 36/127

* cited by examiner

GOLF SHOE WITH AN OUTSOLE HAVING WAVE-LIKE FLEX CHANNELS

CROSS REFERENCE TO RELATED APPLICATIONS

This application is a continuation application of co-pending U.S. application Ser. No. 15/200,488 filed on Jul. 1, 2016, entitled GOLF SHOE WITH AN OUTSOLE HAVING WAVE-LIKE FLEX CHANNELS the contents of which is incorporated by reference herein in their entirety for all purposes.

FIELD OF THE INVENTION

The present disclosure relates generally to golf shoes and, more particularly, to golf shoes having improved outsoles.

BACKGROUND OF THE INVENTION

Historically, people first wore shoes to protect their feet. Over the centuries, footwear evolved into many different types that were specific to particular activities. Thus, the protection offered by a cold-weather work boot is highly different from that offered by a running shoe. In addition to protecting the feet, athletic footwear has further developed to offer specific functions dependent on the particular sport. Soccer shoes, for instance, have spikes for traction, whereas cycling shoes have very stiff soles with mounting plates for cleats to engage the pedal.

The game of golf includes long stretches of walking and short moments of swinging a golf club to hit a golf ball. Golf shoes need to provide sufficient stability and support for the golfer. Thus, many golf shoes include a relatively rigid material such as thermoplastic polyurethane. The plastic material helps provide stiffness and rigidity to the shoe.

At the same time, the golf shoe needs to have sufficient flexibility and should be constructed so that the shoe is not overly rigid. The foot needs to bend during walking and when swinging the golf club. A rigid shoe will require increased physical effort to bend in order to walk, and can lead to a clunky gait and/or cause blisters and other foot problems. The golf shoe industry has looked at different ways for improving the flexibility of the shoe, while maintaining high stability and support.

For example, U.S. Pat. No. 7,895,773 to Robinson, Jr. et al. discloses a golf shoe comprising an upper, a midsole, and an outsole, wherein a collapsible support element is positioned in a recess of the outsole and close to the first metatarsal bone of the foot. The collapsible support element comprises a collapsible gel pad encased in thermoplastic urethane, or a single collapsible element, or a series of collapsible elements. The collapsible element is stiffer in a longitudinal direction and more collapsible in a transverse direction. This helps minimize the impact of ground forces when the golfer is walking, and allows for more efficient transfer of energy during a golf swing.

U.S. Pat. No. 7,143,529 to Robinson, Jr. et al., and U.S. Pat. No. 6,708,426 to Erickson et al., disclose golf shoes having an outsole including a forward portion and a rearward portion that are connected by a ball-and-socket connection that allows the portions to move freely. The outsole may include flexible members disposed between discrete pieces of the forward portion to allow these pieces to flex freely. The outsole also may include a pair of stabilizer rods. The outsole allows for individual movement of the foot, particularly, the rotation between the rearfoot and the forefoot. This helps resist torsional instability during play, provides independent traction suspension, and increases the flexibility of the shoe.

U.S. Pat. No. 5,979,083 to Robinson, Jr. et al. discloses a golf shoe having a two-layered outsole including an outer layer and an inner layer made from thermoplastic compositions. The outer layer forms the bottom of the outsole and has a plurality of first holes at spaced locations therethrough. The inner layer includes a base adjacent one side of the outer layer and a plurality of projections that extend from the base through the first holes in the outer layer, and terminate in a pointed free end. The projections protrude from the bottom of the outsole, and provide traction when the outsole interacts with the ground. The shoe is constructed such that it provides adequate traction during a golf swing and minimizes damage to the turf of golf courses during play.

Although some of the above-described shoes have been somewhat effective in providing sufficient rigidity as well as flexibility, there is a need for an improved outsole. The outsole should provide sufficient rigidity without sacrificing flexibility. A person wearing the shoe should be able to walk comfortably and have sufficient support. The shoe should also hold and support the medial and lateral sides of the golfer's foot as they shift their weight when making a shot. There remains a need for a golf shoe that provides a golfer with sufficient traction, comfort, and support while also allowing efficient energy transfer when they swing.

SUMMARY OF THE INVENTION

In one embodiment, the subject technology is directed to a golf shoe including and upper; a midsole; and an outsole. The outsole has a plurality of flex channels and each flex channel extends in a transverse direction from a lateral edge to a medial edge or an interior region of the outsole. Each flex channel also has at least one curved channel portion. A hard base material surrounds the flex channels. The outsole includes a plurality of receptacles for attaching and removing a plurality of cleats. The hard base material provides stiffness for support and stability while the flex channels allow the outsole to bend when a golfer walks or swings. At least one flex channel may extend from a lateral edge to a receptacle located in the interior region of the shoe. The outsole may have a forward portion, proximate to a wearer's toes, having a plurality of first traction elements. Further, the outsole can have a rear portion, proximate to a wearer's heel, having a plurality of second traction elements. The shoe may have a plurality of ridge segments along a lateral edge of the outsole, proximate to a wearer's cuboid bone. The shoe may also have a plurality of traction elements arranged on the hard base material between the flex channels. The midsole can define a plurality of grooves running adjacent to the flex channels of the outsole.

At least one of the flex channels can have a straight first channel portion, a straight third channel portion, and a curved second channel portion extending between the first channel portion and the third channel portion. The straight first channel portion can have a first length (L1). The curved second channel portion can have a second length (L2). The straight third channel portion can have a third length (L3). In one embodiment, L2 is greater than or equal to L1 while in another L2 is greater than or equal to L3. Further, L2 may be greater than or equal to L1 and L3. The flex channels may have a depth in the range of about 1 to about 5 mm. At least one of the flex channels can have a width in the range of about 2 to about 8 mm. At least two of the flex channels may have different widths. In one embodiment, a first flex channel is located adjacent to second and third flex channels, the first flex channel having a first width (W1) and the second and third channels having second and third widths (W2) and (W3). In this embodiment, W2 is substantially equal to W3 and W1 is greater than W2 and W3.

In another embodiment, the golf shoe includes an upper, a midsole, and an outsole. The outsole has a metatarsal portion proximate to the wearer's metatarsal bones, a calcaneus portion proximate to the user's calcaneus, and an arch portion extending between the metatarsal portion and the calcaneus portion. The outsole has a plurality of flex channels arranged in a pattern of substantially parallel waves, each flex channel extending in a transverse direction from an exterior edge of the outsole to an interior region of the outsole, wherein each flex channel has a at least one curved channel portion. The outsole also includes a hard base material surrounding the flex channels and a plurality of receptacles for attaching and removing a plurality of cleats. The hard base material provides stiffness for support and stability while the flex channels allow the outsole to bend when a golfer walks or swings.

In one embodiment, at least one of the flex channels has a substantially straight first channel portion, a substantially straight third channel portion, and a curved second channel portion extending between the first channel portion and the third channel portion. The straight first channel portion can have a first length (L1). The curved second channel portion can have a second length (L2). The straight third channel portion can have a third length (L3). In one embodiment, L2 is greater than or equal to L1. In another embodiment, L2 is greater than or equal to L3. The golf shoe may have a first flex channel located adjacent to second and third flex channels, the first flex channel having a first width (W1) and the second and third channels having second and third widths (W2) and (W3). In one embodiment, W2 is substantially equal to W3 and W1 is greater than W2 and W3.

Another embodiment of the subject technology is directed to a golf shoe including an upper, a midsole connected to the upper, an outsole coupled to the midsole, and a plurality of receptacles integrated into the outsole for selectively attaching a plurality of cleats. The outsole has a plurality of traction elements and a plurality of flex channels, each flex channel extending in a substantially transverse direction from a lateral edge to a medial edge of the outsole. Preferably, a portion of the flex channels have a straight channel portion and a curved channel portion, the straight channel portion having a radius greater than five inches and the curved channel portion having a radius of less than or equal to five inches. One or more of the flex channels may be V-shaped and extend completely across the outsole. At least one of the flex channels can be U-shaped and terminate in one of the receptacles. The traction elements and flex channels are arranged in a first wave-like pattern on a forefoot portion of the outsole. The traction elements and flex channels are arranged in a second wave-like pattern on a heel portion of the outsole. The U-shaped flex channel has a first width (W1), the traction elements have a second width (W2), and the V-shaped flex channel has a third width (W3) so that W2>W1>W3. The traction elements have a first depth (D1), the V-shaped flex channel has a second depth (D2), and the U-shaped flex channel has a third depth (D3) so that D1>D3>D2. At least one of the flex channels has a straight channel portion, a first curved channel portion, and a second curved channel portion with the first and second channel portions being opposing. The outsole provides stiffness for support and stability and the flex channels allow the outsole to bend when a golfer walks and swings.

It should be appreciated that the subject technology can be implemented and utilized in numerous ways, including without limitation as a process, an apparatus, a system, a device, a method for applications now known and later developed. These and other unique features of the system disclosed herein will become more readily apparent from the following description and the accompanying drawings.

BRIEF DESCRIPTION OF THE DRAWINGS

The accompanying drawings form a part of the specification and are to be read in conjunction therewith. In the various views, like reference numerals are used to indicate like parts.

DETAILED DESCRIPTION OF THE INVENTION

Figure 1A:
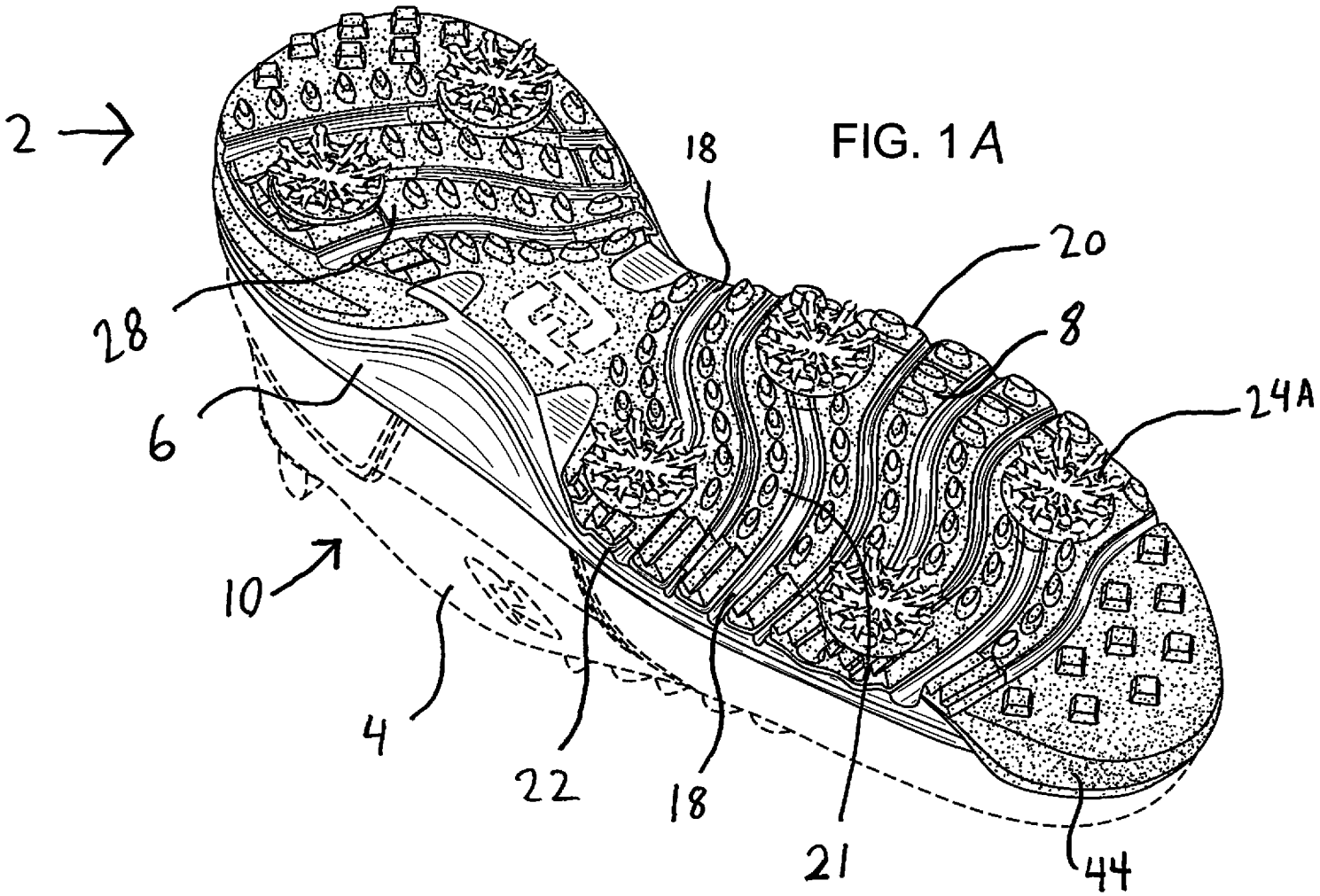
FIG. 1A is a bottom perspective view of a golf shoe in accordance with the subject technology.
Figure 1B:
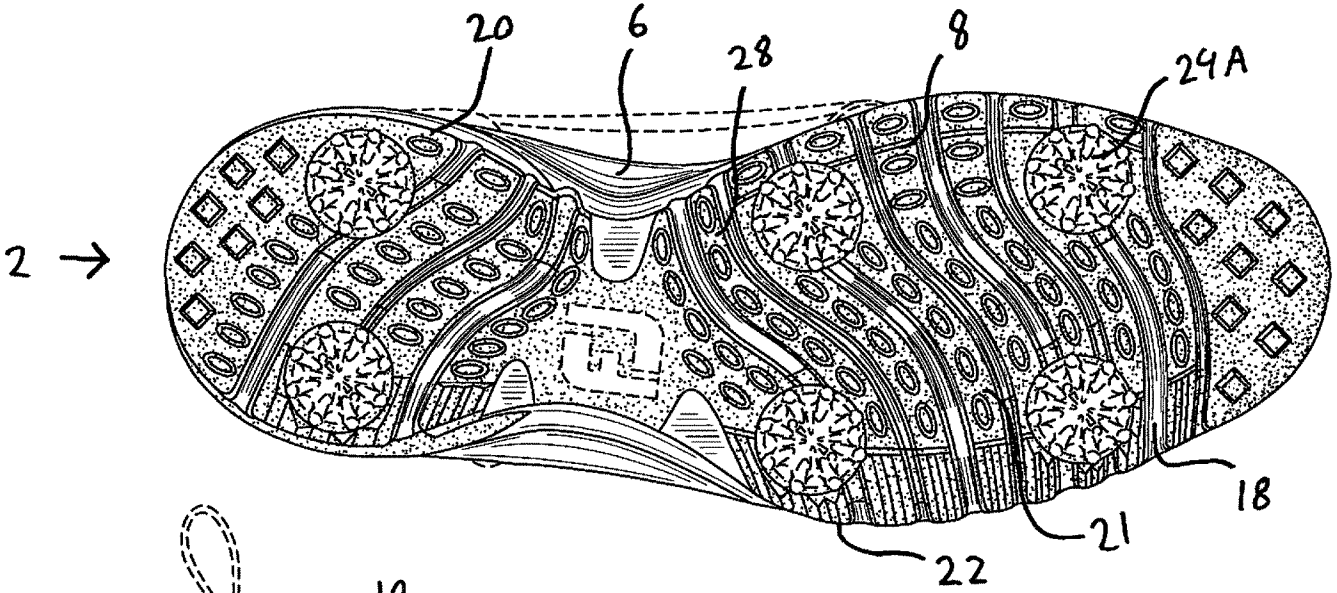
FIG. 1B is a bottom view of an outsole of a golf shoe in accordance with the subject technology.
Figure 1C:
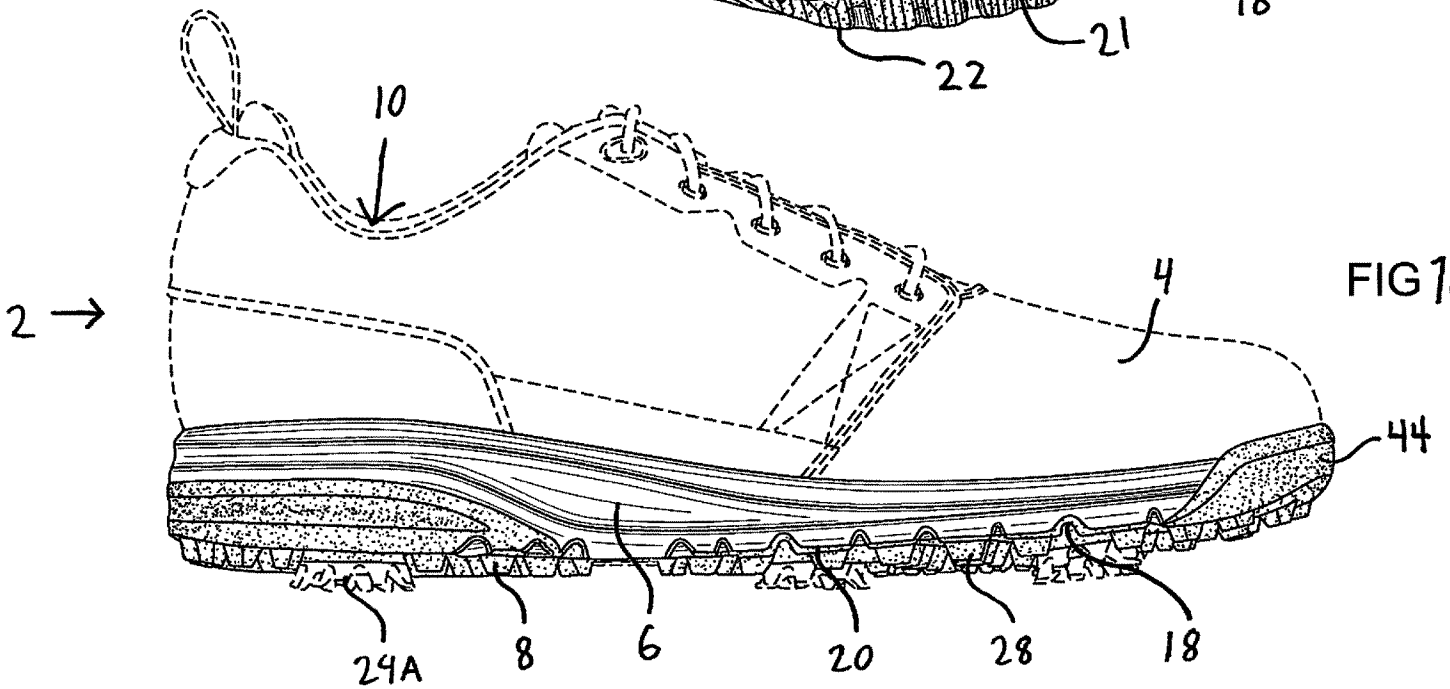
FIG. 1C is a side view of the medial side of a golf shoe in accordance with the subject technology.
Figure 1D:
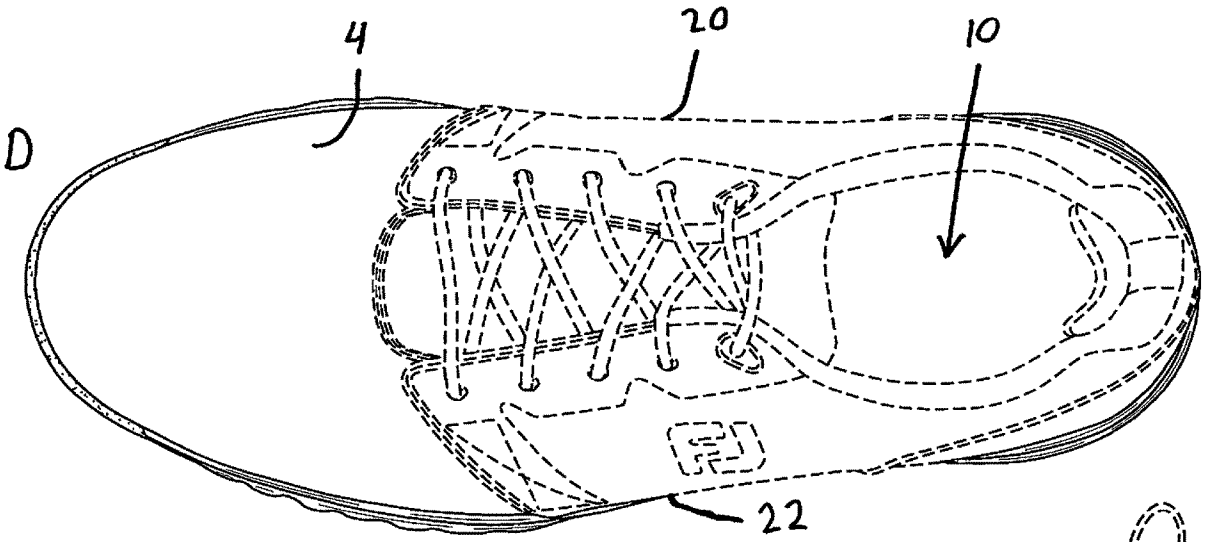
FIG. 1D is a top view of a golf shoe in accordance with the subject technology.
Figure 1E:
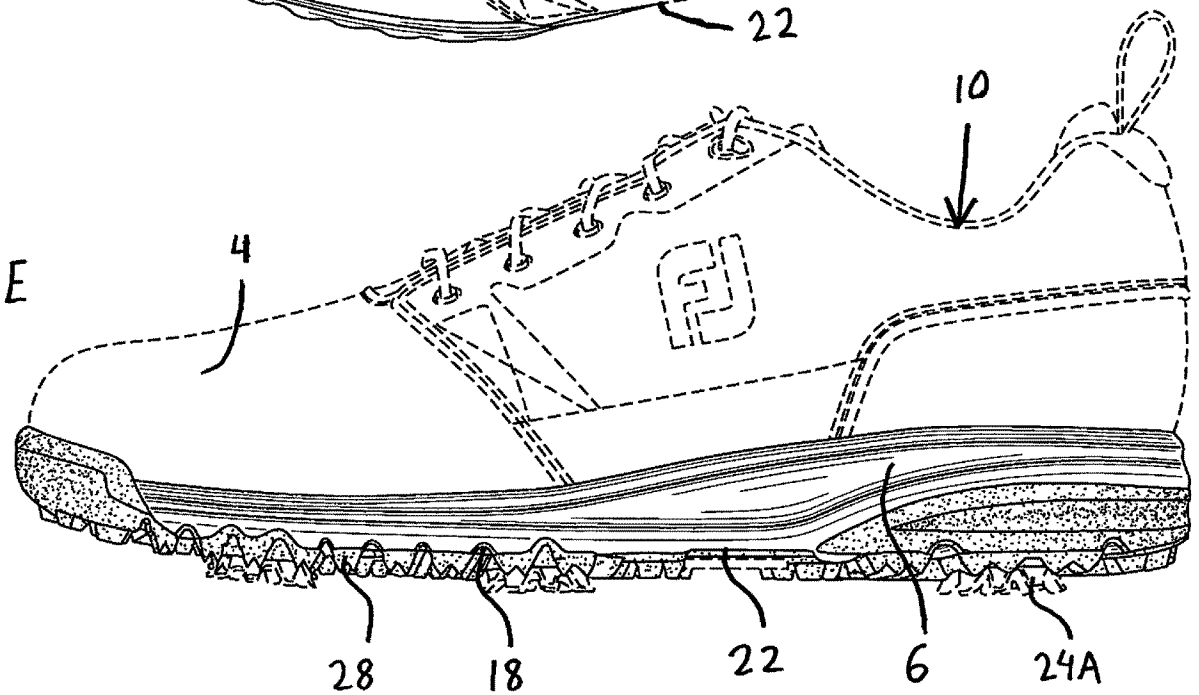
FIG. 1E is a side view of the lateral side of a golf shoe in accordance with the subject technology.
Figure 1F:
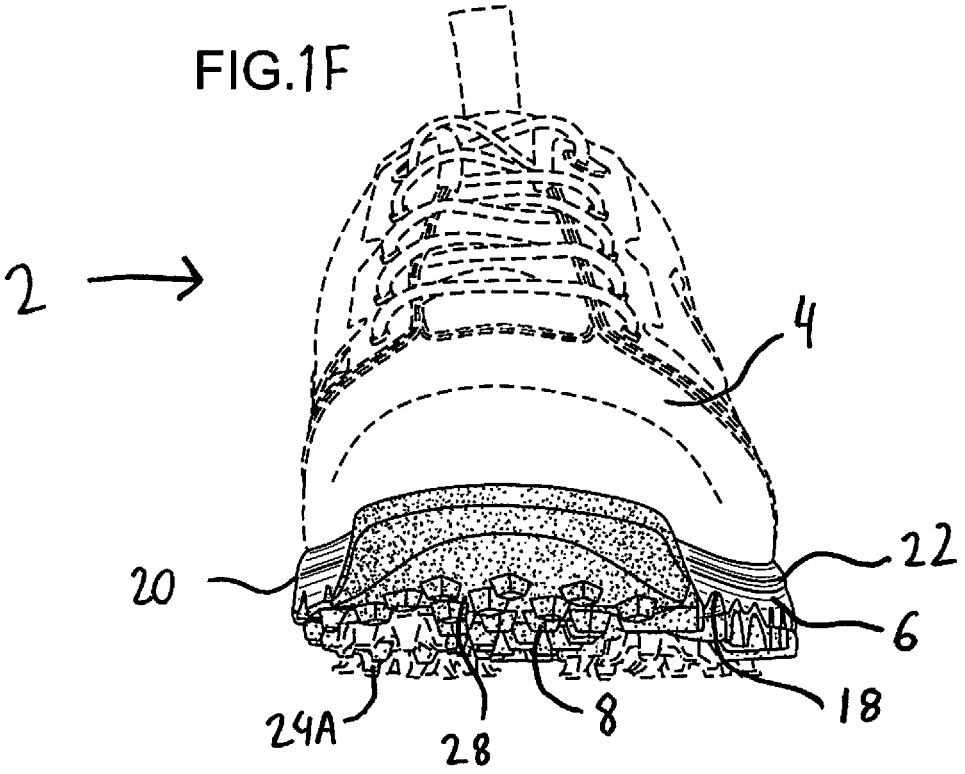
FIG. 1F is a front view of a golf shoe in accordance with the subject technology.
Figure 1G:
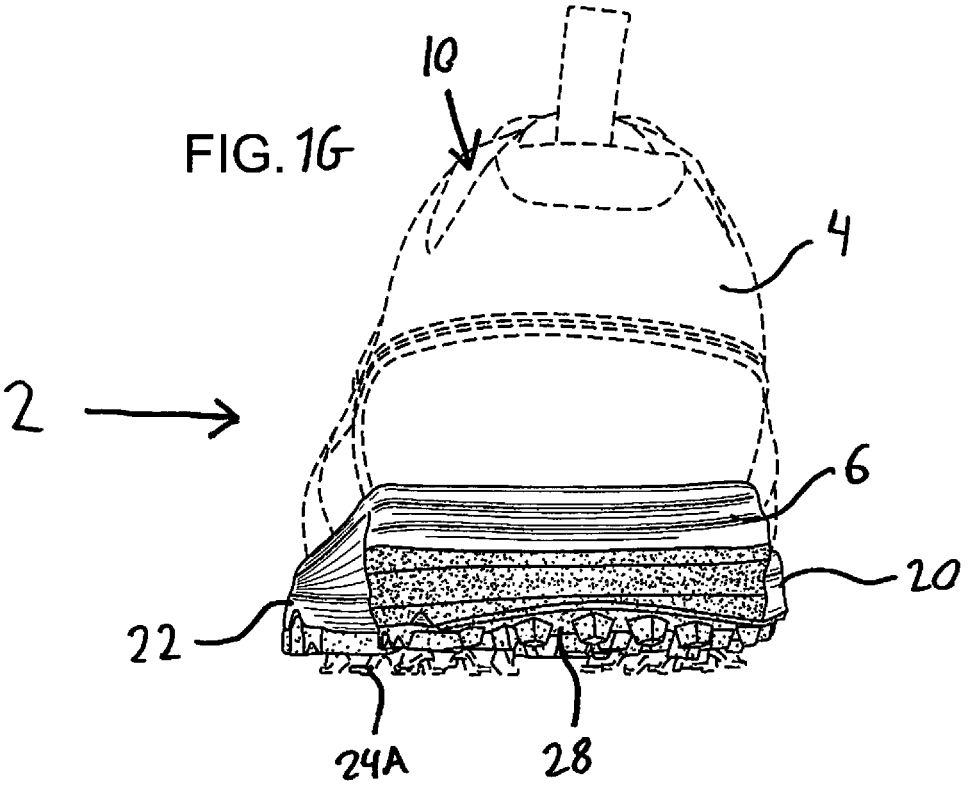
FIG. 1G is a back view of a golf shoe in accordance with the subject technology.
Figure 2:
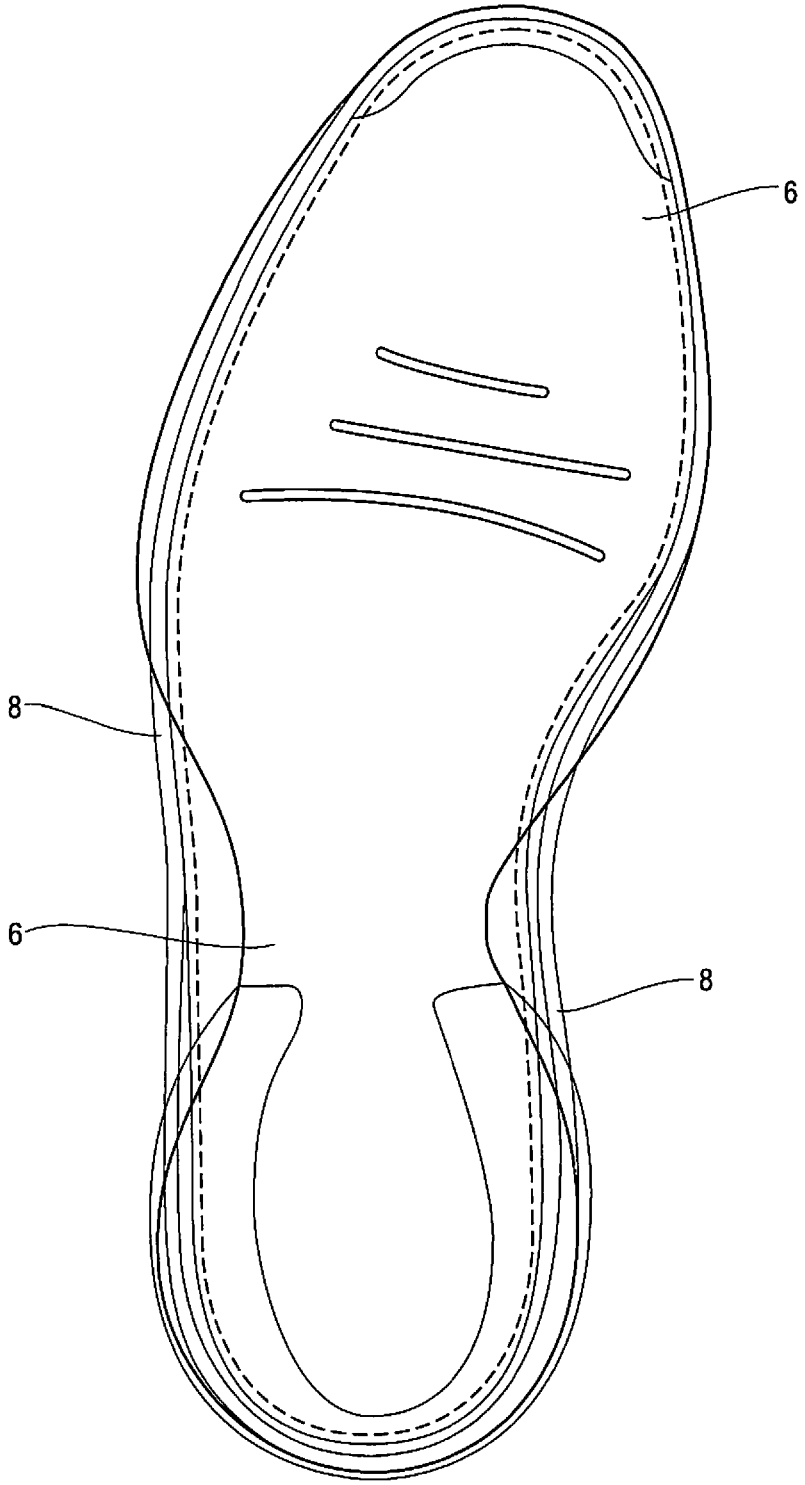
FIG. 2 is a top view of a midsole of a golf shoe in accordance with the subject technology.
Figure 3:
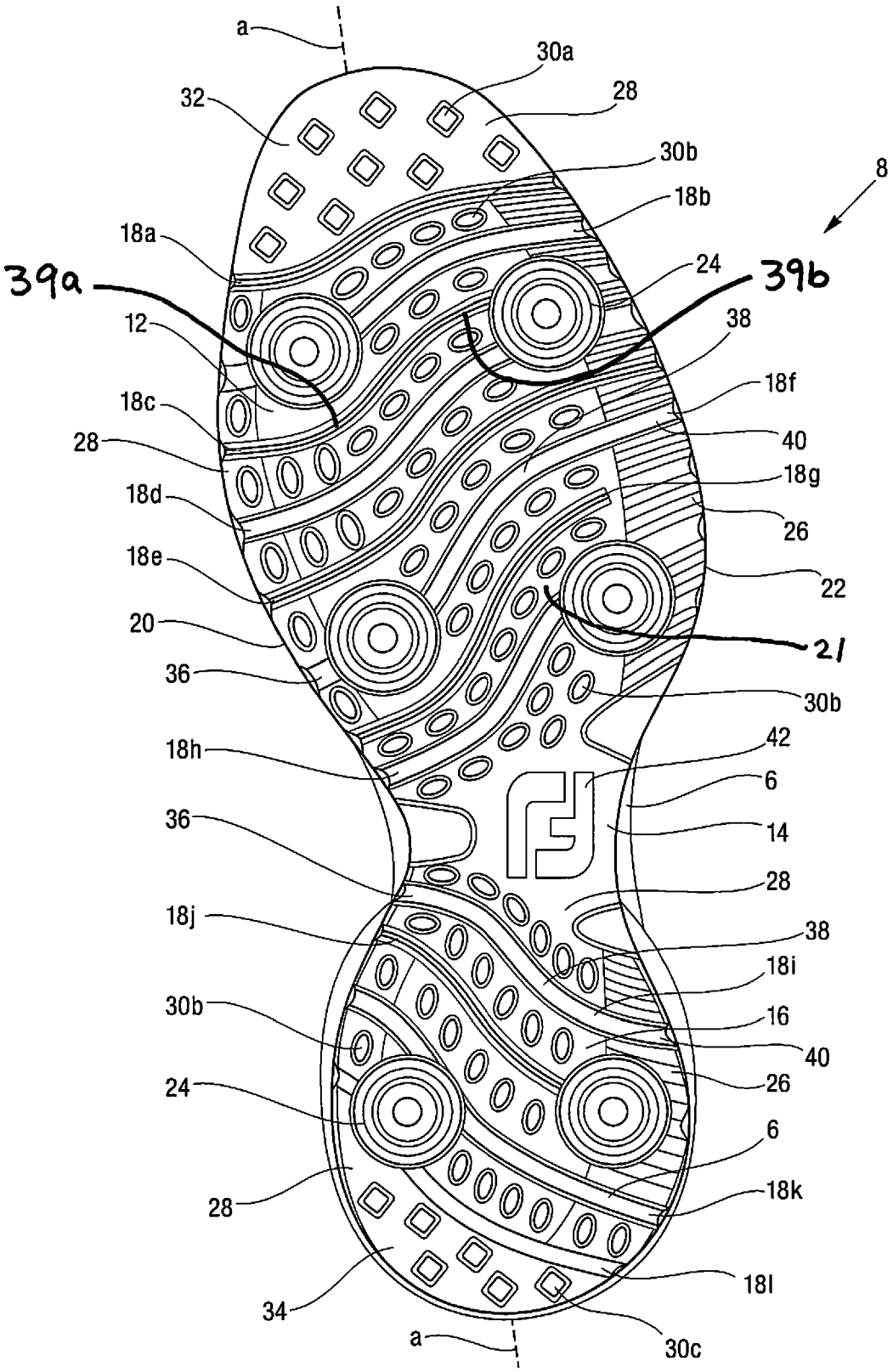
FIG. 3 is a bottom view of an outsole of a golf shoe in accordance with the subject technology.
Figure 5:
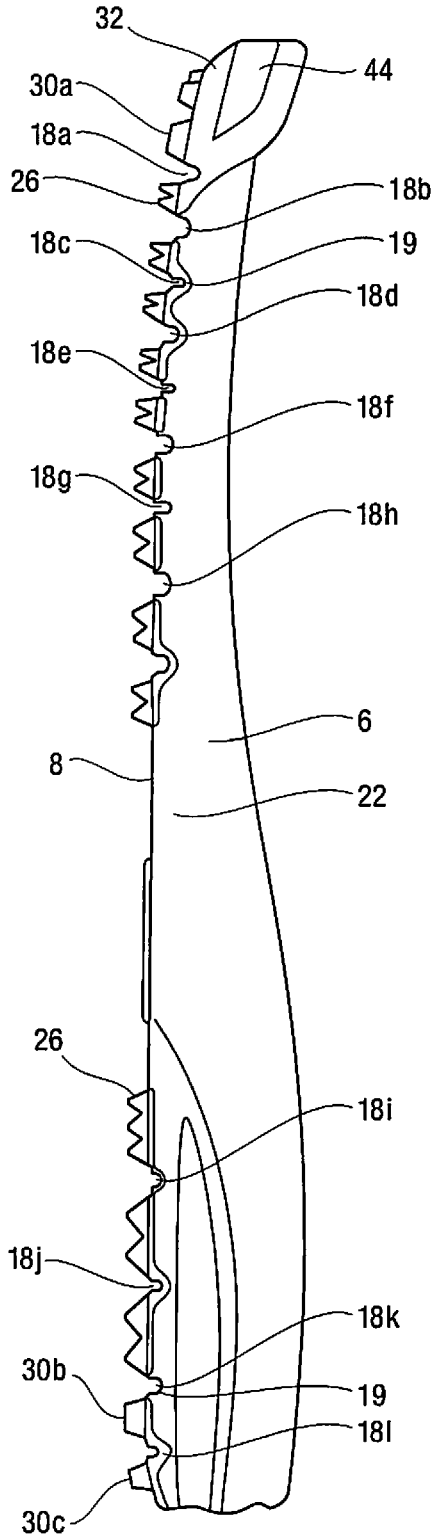
FIG. 5 is a side view of the lateral edge of an outsole and midsole of a golf shoe in accordance with the subject technology.

The subject technology improves upon the prior art of golf shoes. The advantages, and other features of the technology disclosed herein, will become more readily apparent to those having ordinary skill in the art from the following detailed description of certain preferred embodiments taken in conjunction with the drawings which set forth representative embodiments of the present technology and wherein like reference numerals identify similar structural elements. All views shown in FIGS. 1-7 are for a left shoe, the components for a right shoe being mirror images thereof. As used herein, "medial edge" refers to the inside peripheral edge of the shoe, generally closest to the other shoe of the user, while "lateral edge" refers to the outside peripheral area of the shoe, generally furthest from the other shoe of the user. The embodiments shown relate to a men's size 9.5 shoe. One skilled in the art would understand that adjustments may be made to the components shown to produce the same shoe in other sizes.

Referring now to FIGS. 1A-1G and 2, a left shoe in accordance with the subject technology is shown generally at 2. The shoe 2 includes an upper 4, a midsole 6 joined to the upper 4, and an outsole 8 joined to the midsole 6. The upper 4 includes an opening 10 for the wearer to insert their left foot. Once the wearer's foot is inserted, the upper 4 provides a covering for the foot and helps hold the foot securely in place with respect to the other components of the shoe 2. The upper 4 is secured to the midsole 6. When the user's foot is placed within the shoe 2, the midsole 6 provides cushioning between the bottom of a wearer's foot and a ground surface. The outsole 8 is secured to the underside of the midsole 6 and provides traction between the shoe 2 and a ground surface. Further, the outsole 8 provides stability to the wearer.

The shoe 2 has a medial edge 20 running along the inside periphery of the shoe (i.e. for a someone wearing a left shoe, the medial edge 20 would run along the right side of the left shoe) and a lateral edge 22 running along the outside peripheral of the shoe (i.e. for a someone wearing a left shoe, the lateral edge 22 would run along the left side of the shoe). The shoe has an interior region 21, located on the outsole 8 between the medial and lateral edges 20, 22.

The upper 4 is usually formed from materials such as leather, synthetic materials, or textiles, or some combination of these that are stitched or adhesively bonded together, for example. The upper 4 can be secured to the midsole 6 by stitching or with cement or other adhesives using an insole board and conventional techniques known to those skilled in the art. The midsole 6 can be formed of materials such as polyurethane and/or ethylene vinyl acetate copolymer (EVA), for example. In one embodiment, the midsole is formed of a thermoplastic polyurethane that is substantially soft, having a hardness of less than 85 Shore A. Preferably, the midsole is formed from an EVA composition preferably having a hardness of less than 70 Shore A. The midsole 6 may be formed on or about the outsole 8, or formed separately and attached with an adhesive or stitching. The outsole 8 may be formed by various conventional methods. For example, one method is disclosed in U.S. Pat. No. 5,979,083 issued to Robinson et al. According to this method, first and second layers are molded together to form the outsole 8.

The golf shoe 2 also includes golf cleats 24A. Golf cleats 24A can be attached to the receptacles 24 (shown in FIG. 3) by placing a golf cleat 24A into a receptacle and twisting the cleat 24A clockwise. The attached cleats 24A provide additional traction between the shoe 2 and a ground surface for the user.

Referring now to FIGS. 3-7, more detailed depictions of the outsole of a left shoe, in accordance with the subject technology are shown generally at 8. The outsole 8 includes a metatarsal portion 12 positioned generally under a wearer's metatarsal bones, an arch portion 14 positioned generally under a wearer's foot arch, and a calcaneus portion 16 positioned generally under a wearer's calcaneus bone. The metatarsal and calcaneus portions 12, 16 include flex channels 18*a*-1, which are voids in the outsole 8 of the shoe, extending in wave-like patterns across the outsole 8.

The flex channels 18*a*-1 allow the outsole 8 to flex and bend when a user walks or swings. The flex channels 18 *a*-1 generally run along the interior region 21 between the medial edge 20 and the lateral edge 22 of the outsole 8. In the embodiment shown, the outsole 8 includes eight flex channels 18*a*-18*h* across the metatarsal portion 12 and four flex channels 18*i*-18*l* across the calcaneus portion 16. The flex channels 18*a*-1 include substantially straight portions 36, 40 and curved portions 38 in various combinations. For example, some flex channels 18*a*, 18*i*, 18*f* include a first substantially straight portion 36, a second curved portion 38, and a third substantially straight portion 40. Other flex channels 18*d*, 18*g* may include, for example, just a first substantially straight portion 36 and a second curved portion 38. Still another flex channel 18*c* includes a first straight portion 36 and a curved portion 38 that includes two arcuate section 39*a*, 39*b*, wherein section 39*a* arcs in one direction and section 39*b* arcs in an opposing direction. In one embodiment, the radius of the arcs is less than 5 inches.

In some areas, grooves 19 (seen in FIGS. 4-5) run across the midsole 6 adjacent to the flex channels 18*a*-1 in the outsole 8 to provide additional flexibility. One skilled in the art would recognize that depending on the desired flexibility and support, the flex channels 18*a*-1 may be formed using other combinations of a first substantially straight portion 36, a second curved portion, 38, and a third substantially straight portion 40, which may or may not coincide with grooves 19.

Further, the total number of flex channels 18*a*-1 may vary depending on the desired flexibility of the outsole 8 and size of the shoe. Similarly, the depth, width and shape of the flex channels 18*a*-1, may be varied depending on desired flexibility of the outsole 8. The depth of the flex channels 18*a*-1 may be, for example, within the range of about 1 to about 5 mm or about 3.5 mm. Additionally the width of the flex channels 18*a*-1, or the width of portions of the flex channels 36, 38, 40, may be adjusted depending on desired flexibility. The flex channels 18*a*-1 may have a width ranging from about 2 to 8 mm, for example. Additionally, various flex channels 18*a*-1 may have different widths from one another, for example, by about 4 to 6 mm. As shown, flex channels 18*a*, 18*c*, 18*e*, 18*g* and 18*j* are V-shaped and flex channels 18*b*, 18*d*, 18*f*, 18*h*, 18*i*, 18*k* and 18*l* are U-shaped. The flex channels 18*a*-1 could also be trapezoidal, rectangular, W-shaped and the like. One skilled in the art would understand that various widths, depths and shapes of the flex channels, or portions thereof, could be adjusted depending on desired flexibility.

In the forefoot or metatarsal portion 12, the V-shaped flex channels 18*a*, 18*e* go completely across while V-shaped flex channels 18*c*, 18*g* go substantially across the outsole 8 in the transverse direction. In contrast, the U-shaped flex channels 18*b*, 18*d*, 18*f*, 18*h* terminate at a receptacle 24. In the heel or calcaneus portion 16, the V-shaped flex channel 18*j* terminates at a receptacle 24 while U-shaped flex channels 18*i*, 18*k*, 18*l* go substantially across the outsole 8 in the transverse direction with U-shaped flex channels 18*k*, 18*l* passing across a receptacle 24.

Still referring now to FIGS. 3-7, a hard base material 28 extends across the outsole 8 and surrounds the flex channels 18. The hard base material 28 provides stiffness and stability to the outsole 8. The hard base material 28 may be a material such as thermoplastic polyurethane or the like, and may have a hardness of at least 80 Shore A. The hard base material 28 does not constitute the entire outsole of the shoe. Rather, as shown in the Figures, the flex channels constitute a portion of the outsole of the shoe. The flex channels 18 are made of a relatively soft material such as EVA. In one preferred embodiment, the flex channels 18 comprise the same EVA or other material used to make the midsole 6 of the shoe. The exposed midsole areas of the shoe form the flex channels 18. The midsole (that is, the flex channels) is plainly visible to a person looking at the outsole 8 of the shoe.

The outsole 8 also has a series of traction elements 30*a*-*c*, extending from the hard base material 28, which provide traction between the outsole 8 and a ground surface. A series of middle traction elements 30*b* protrude from the metatarsal and calcaneus portions 12, 16, running between the medial and lateral edges 20, 22 in between the flex channels 18. This placement of the middle traction elements 30*b* allows the middle traction elements 30*b* to provide traction while still allowing the outsole 8 to flex and bend. In one embodiment, the outsole 8 includes a cluster of middle traction elements 30*b* on the metatarsal portion 12, adjacent to the arch portion 14.

Figure 4:
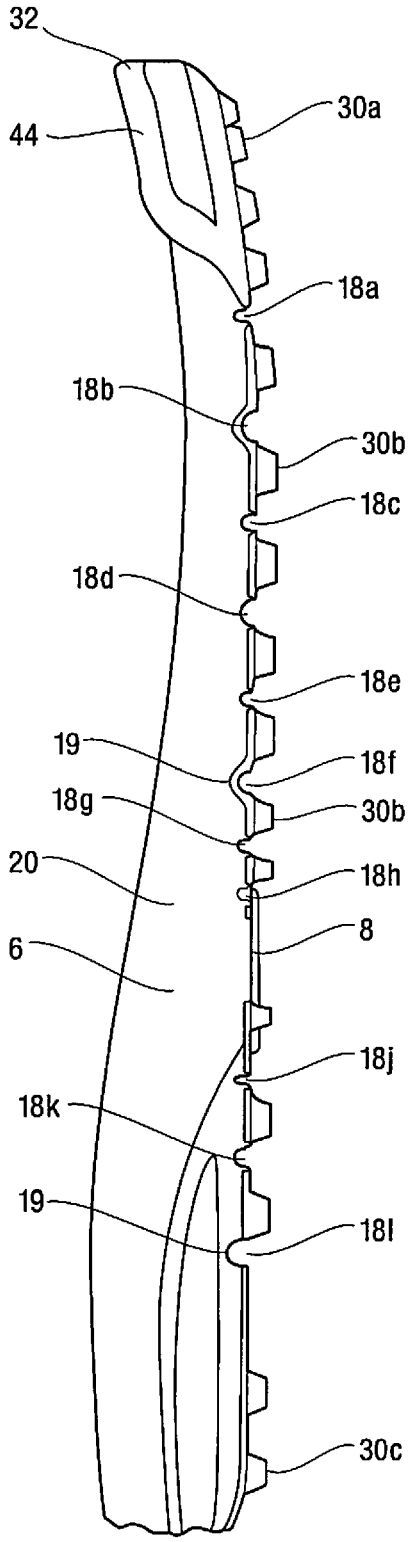
FIG. 4 is a side view of the medial edge of an outsole and midsole of a golf shoe in accordance with the subject technology.
Figure 4A:
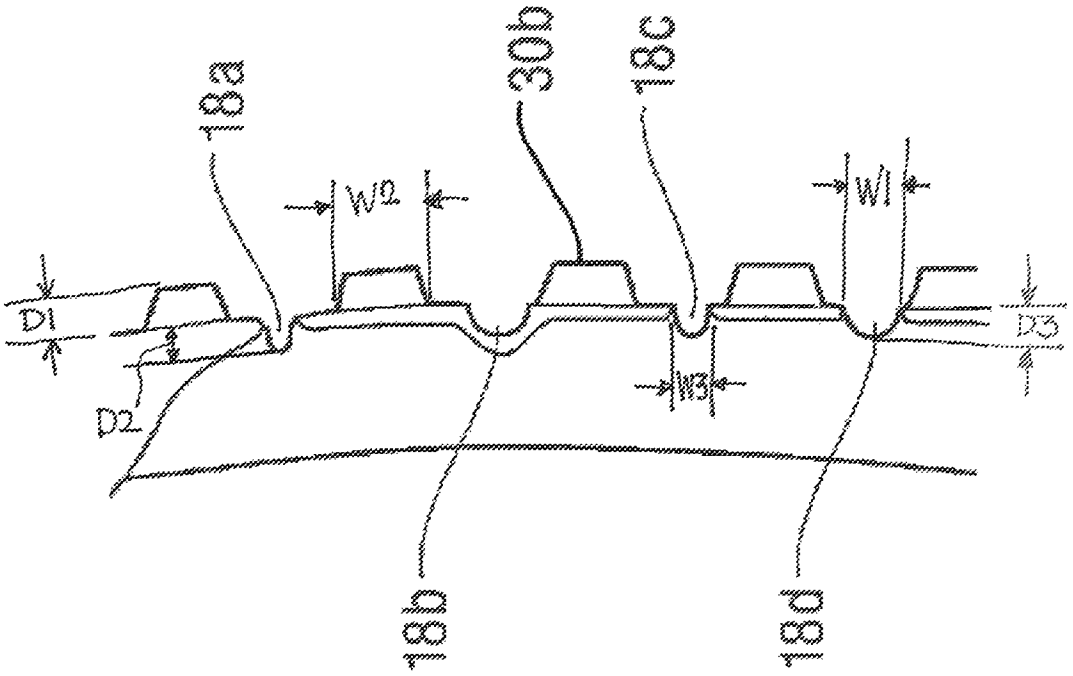
FIG. 4A is an enlarged side view of a portion of the medial edge of the outsole and midsole of the golf shoe of FIG. 4.
Figure 6:
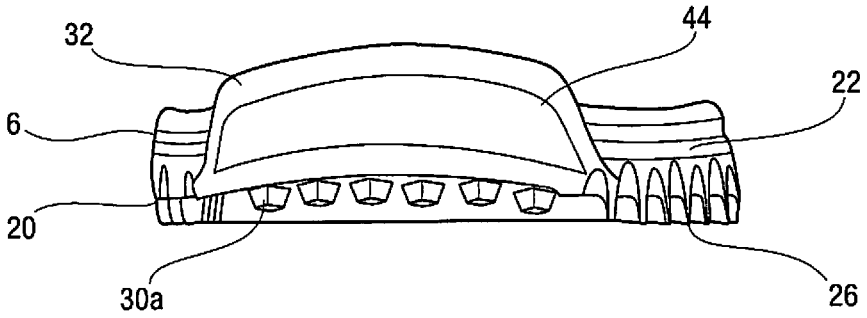
FIG. 6 is a front view of an outsole and midsole of a golf shoe in accordance with the subject technology.
Figure 7:
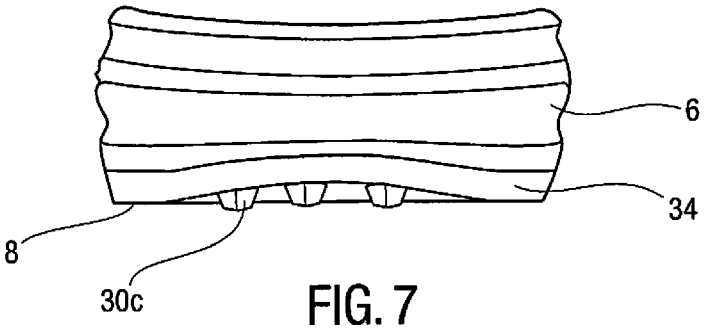
FIG. 7 is a rear view of an outsole and midsole of a golf shoe in accordance with the subject technology.

Referring now to FIG. 4A, an enlarged side view of a portion of the medial edge 20 of the outsole 8 and midsole 6 of the golf shoe 2. The U-shaped flex channels 18 have a first width (W1), the traction elements 30*b* have a second width (W2) and the V-shaped flex channels 18 have a third width (W3), wherein W2>W1>W3. The traction elements 30*b* have a first depth (D1), the V-shaped flex channels 18 have a second depth (D2), and the U-shaped flex channels 18 have a third depth (D3), wherein D1>D3>D2.

Referring again to FIGS. 3-7, in one embodiment, the outsole 8 also includes a forward portion 32, formed of the hard base material 28 and positioned generally under the toes of a wearer, which has a series of traction elements 30*a*. The forward portion 32 also includes a toe kick 44. In yet another embodiment, the outsole 8 also includes a rear portion 34, formed of the hard base material 28 and positioned below a wearer's heel along the longitudinal axis "a", which has a series of traction elements 30*c*. Less bending and flexing is needed in the forward and rear portions 32, 34 of the outsole 8, and thus, the forward and rear portions 32, 34 may be formed entirely of hard base material 28. Additionally, the forward and rear portion 32, 34 may have clusters of traction elements 30*a*, 30*c*.

The traction elements 30*a*-*c* are shaped to dig into a ground surface, providing traction between the outsole 8 and the ground surface. The traction elements 30*a*-*c* are a collection of ovals and squares in various orientations. One skilled in the art would recognize that the traction elements 30*a*-*c* may be hyperrectangle, cylindrical, triangular or any other shape suitable for providing traction.

In some embodiments, ridges 26 run along the lateral edge 22 of the outsole 8 to provide addition traction between the outsole 8 and a ground surface. Particularly, the ridges 26 prevent the outsole 8 from sliding, with respect to a ground surface, along the longitudinal axis "a." The ridges 26 interrupt certain of the flex channels 18*e*, 18*g*, preventing some of the flex channels 18*e*, 18*g* from running the entire width of the outsole 8 between the medial and lateral edges 20, 22.

As noted above, some flex channels 18*b*, 18*c*, 18*d*, 18*f*, 18*j*-1 are interrupted by receptacles 24. Golf cleats 24*a* selectively attach to the receptacles 24 by inserting a suitable golf cleat and twisting the cleat clockwise. Attaching cleats may provide more traction between the outsole 8 and a ground surface, especially when the wearer is executing a golf shot. Further, over time the traction elements 30 and ridges 26 suffer normal wear through use. While cleats 24*a* can be attached, removed, and replaced through the cleat receptacles 24, the traction elements 30 and ridges 26 cannot be replaced. Thus, when replacing cleats 24*a*, the golfer can strategically choose the height of replacement cleats to match that of the traction elements 30 and ridges 26. For example, if the cleats are replaced after a relatively long amount of time (e.g., one year), then replacement cleats of a shorter height can be used to match the height of the traction elements 30 and ridges 26, if the traction elements 30 and ridges 26 have diminished in height as well.

A logo assembly 42 is positioned along the arch portion 14 of the outsole 8 and may include a transparent layer material to protect the logo when the outsole 8 contacts a ground surface and permit visibility of the logo. One preferred material of the logo assembly 42 is the hard base material 28 described herein.

When golfers swing a club, their weight shifts along both the longitudinal axis "a" and between the medial and lateral edge 20, 22 of the outsole 8. When golfers walk, their feet typically move along the longitudinal axis "a", transferring weight between the heel and the toe.

The hard base material 28 provides stiffness to the outsole 8 of the shoe which allows for support and stability when a golfer walks, and also during a golfer's swing. The flex channels 18 represent a break in the hard base material 28 which allows the outsole 8 to bend and flex around the underlying midsole 6, particularly along the longitudinal axis "a", but also across the width of the shoe between the medial and lateral edge 20, 22.

Typically, creating a straight channel along the outsole of a shoe allows the outsole to fold around that channel and therefore provides for bending around the axis created by that channel. In the shoe 2, the flex channels 18 do not run straight across the width of the entire shoe 2 between the medial and lateral edges 20, 22. Instead, the flex channels 18 include straight channel portions 36 and curved channel portions 38 which prevent a uniform straight channel across the entire outsole 8 around which the outsole 8 could fold. The curved channel portions 38 allow for various amounts of hard base material 28 to resist folding around the axes generally formed by each flex channel 18. Further, certain of the flex channels 18 are interrupted by receptacles 24 and/or ridges 26 which are formed of hard base material 28 and resist bending along the general axis of the respective flex channel 18. Still further, the traction elements 30*b* are arranged along a parallel path to the flex channels 18. Preferably, in the curved channel portions 38, the oval traction elements 30*b* are arranged lengthwise and, in the straight channel portions 36, the oval traction elements 30*b* are arranged so the elongated portion is substantially normal to the respective straight channel portion 36.

Thus when a golfer shifts their weight, for example, from heel to toe, the flex channels 18 allow for some bending while the hard base material 28 resists bending and provides support and stability. Therefore when a golfer walks, and shifts their weight between their heel and toe, the outsole 8 bends around the flex channels 18 to provide comfort to the user, but the shoe remains structurally stable. Similarly, when a golfer swings, stressing the outsole 8 along the longitudinal axis "a" and between the medial and lateral edge 20, 22 creates a more efficient transfer of energy for the wearer. Throughout the golfer's swing the wave-like nature of the flex channels 18 allows the hard base material 28 to prevent excessive bending and helps the outsole 8 offer sufficient support and stability.

Preferably, the flex channels 18*a*-1 and traction elements 30*b* are arranged in a generally parallel wave-like pattern. The wave pattern may be sinusoidal or another variation. The metatarsal portion 12 and the calcaneus portion 16 may have flex channels 18 on the same wave-like pattern or, as shown, the calcaneus portion 16 has a wave-like pattern along an axis that is at an angle with respect to the pattern axis of the metatarsal portion 12. Preferably, a section of a flex channel 18 would be considered curved is the radius of the curved section 38 is less than or equal to 5 inches. A section of a flex channel 18 that would be considered straight would have a radius of greater than 5 inches.

All patents, patent applications and other references disclosed herein are hereby expressly incorporated in their entireties by reference.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with feature(s) and/or element(s) from other embodiment(s). Therefore, it will be understood that the appended claims are intended to cover all such modifications and embodiments, which would come within the spirit and scope of the present invention.

What is claimed is:

1. A golf shoe comprising:

an upper;

a midsole; and an outsole having:

a plurality of flex channels, each flex channel extending in a transverse direction from a lateral edge to a medial edge or an interior region of the outsole, wherein each flex channel has at least one curved channel portion, the curved portions being substantially parallel, and at least one of the flex channels has i) a straight first channel portion; ii) a straight third channel portion; and iii) a curved second channel portion of the at least one curved channel portion extending between the first channel portion and the third channel portion;

a hard base material surrounding the flex channels; and a plurality of receptacles for attaching and removing a plurality of cleats, wherein the hard base material provides stiffness for support and stability and the flex channels allow the outsole to bend when a golfer walks or swings, wherein the flex channels pass through the receptacles.

2. The golf shoe of claim 1, wherein: the straight first channel portion has a first length (L1); the curved second channel portion has a second length (L2); the straight third channel portion has a third length (L3); and L2 is greater than or equal to L1.

3. The golf shoe of claim 2, wherein: the straight first channel portion has a first length (L1); the curved second channel portion has a second length (L2); the straight third channel portion has a third length (L3); and L2 is greater than or equal to L3.

4. The golf shoe of claim 1, wherein: the straight first channel portion has a first length (L1); the curved second channel portion has a second length (L2); the straight third channel portion has a third length (L3); and L2 is greater than or equal to L1 and L3.

5. The golf shoe of claim 1, wherein a first flex channel is located adjacent to second and third flex channels, the first flex channel having a first width (W1) and the second and third channels having second and third widths (W2) and (W3), and W2 is substantially equal to W3 and W1 is greater than W2 and W3.

6. The golf shoe of claim 1, wherein at least one of the flex channels has a straight first portion and a curved second portion, the curved portion having a first arcuate section that arcs in a first direction, and a second arcuate section that arcs in an opposing direction.

7. The golf shoe of claim 1, wherein at least two of the flex channels pass across one of the receptacles.

8. A golf shoe comprising:

an upper;

a midsole;

and an outsole having: a metatarsal portion proximate to the wearer's metatarsal bones; a calcaneus portion proximate to the wearer's calcaneus; and an arch portion extending between the metatarsal portion and the calcaneus portion;

a plurality of flex channels, at least some of the flex channels arranged in a pattern of substantially parallel waves, each flex channel extending in a transverse direction from an exterior edge of the outsole to an interior region of the outsole, wherein each flex channel has a at least one curved channel portion, and at least one of the flex channels has i) a straight first channel portion; ii) a straight third channel portion; and iii) a curved second channel portion extending between the first channel portion and the third channel portion;

a hard base material surrounding the flex channels; and a plurality of receptacles for attaching and removing a plurality of cleats, wherein the hard base material provides stiffness for support and stability and the flex channels allow the outsole to bend when a golfer walks or swings, wherein at least some of the flex channels pass through the receptacles.

9. The golf shoe of claim 8, wherein: the straight first channel portion has a first length (L1); the curved second channel portion has a second length (L2); the straight third channel portion has a third length (L3); and L2 is greater than or equal to L3.

10. The golf shoe of claim 8, wherein: the straight first channel portion has a first length (L1); the curved second channel portion has a second length (L2); the straight third channel portion has a third length (L3); and L2 is greater than or equal to L1 and L3.

11. The golf shoe of claim 8, wherein at least one of the flex channels has a straight first portion and a curved second portion, the curved portion having a first arcuate section that arcs in a first direction, and a second arcuate section that arcs in an opposing direction, wherein each arc has a radius of less than five inches.

12. The golf shoe of claim 8, wherein the metatarsal portion and calcaneus portion contain the flex channels in the same pattern.

13. The golf shoe of claim 8, wherein the metatarsal portion contains the flex channels and the calcaneus portion contains a second plurality of flex channels, the second plurality of flex channels arranged in a pattern of substantially parallel waves along an axis that is at an angle with respect to the pattern of the flex channels in the metatarsal portion.

14. The golf shoe of claim 13, wherein there are eight flex channels across the metatarsal portion and four flex channels across the calcaneus portion.

15. The golf shoe of claim 13 wherein:

at least one of the flex channels in the metatarsal portion terminates at one of the plurality of receptacles;

a plurality of flex channels in the metatarsal portion pass across one of the plurality of receptacles;

at least one of the flex channels in the calcaneus portion terminates at one of the plurality of receptacles; and a plurality of flex channels in the calcaneus portion pass across one of the plurality of receptacles.

* * * * *